US010071849B2

(12) United States Patent
Nasr et al.

(10) Patent No.: US 10,071,849 B2
(45) Date of Patent: Sep. 11, 2018

(54) VALVE ASSEMBLY

(71) Applicant: The Salford Valve Company LTD., Salford, Manchester Greater Manchester (GB)

(72) Inventors: Ghasem Nasr, Stockport Chesire (GB); Amir Nourian, Stockport Chesire (GB); Tom Goldberg, Salford (GB); Gary Hawthorne, Salford (GB)

(73) Assignee: The Salford Valve Company LTD. (GB)

( * ) Notice: Subject to any disclaimer, the term of this patent is extended or adjusted under 35 U.S.C. 154(b) by 0 days.

(21) Appl. No.: 15/315,606

(22) PCT Filed: Jun. 1, 2015

(86) PCT No.: PCT/GB2015/051588

§ 371 (c)(1),
(2) Date: Dec. 1, 2016

(87) PCT Pub. No.: WO2015/185904

PCT Pub. Date: Dec. 10, 2015

(65) Prior Publication Data

US 2017/0197776 A1 Jul. 13, 2017

(30) Foreign Application Priority Data

Jun. 3, 2014 (GB) ..... 1409861

(51) Int. Cl.
*B65D 83/48* (2006.01)
*B05B 7/04* (2006.01)
(Continued)

(52) U.S. Cl.
CPC ..... *B65D 83/48* (2013.01); *B05B 1/341* (2013.01); *B05B 7/0483* (2013.01); *B65D 83/207* (2013.01); *B65D 83/28* (2013.01)

(58) Field of Classification Search
CPC ..... B05B 1/341; B05B 7/0483; B65D 83/28; B65D 83/207; B65D 83/48; B65D 83/20; B65D 83/44
See application file for complete search history.

(56) References Cited

U.S. PATENT DOCUMENTS 3,191,816 A 6/1965 Fead et al.
3,770,166 A 11/1973 Marand
(Continued)

FOREIGN PATENT DOCUMENTS

EP 0751083 A1 1/1997
WO 9301996 A1 2/1993
(Continued)

OTHER PUBLICATIONS

GB Search Report for Application No. GB1409861.0 dated Aug. 1, 2014.
(Continued)

*Primary Examiner* — Christopher Kim
(74) *Attorney, Agent, or Firm* — Lerner, David, Littenberg, Krumholz & Mentlik, LLP

(57) ABSTRACT

A valve assembly including a housing with an internally projecting lip that seals against an outer surface of a valve stem inserted through it. A gas inlet is provided above the lip and a liquid inlet is provided below the lip. The lip thus ensures that a gas flow path and a liquid flow path are kept separate until the valve stem is moved to an open position, at which point a liquid inlet hole in the stem is brought into communication with the liquid inlet in the housing and a gas inlet hole in the stem is brought into communication with the gas inlet in the housing for the fluids mix in an outlet conduit in the stem. The arrangement means that there is no contact between the liquid and a sealing gasket, thereby avoiding swelling of the gasket that can cause the stem to stick.

20 Claims, 6 Drawing Sheets

(51) Int. Cl.

| | |
|---|---|
| ***B05B 1/34*** | (2006.01) |
| ***B65D 83/20*** | (2006.01) |
| ***B65D 83/28*** | (2006.01) |

(56) References Cited

U.S. PATENT DOCUMENTS

| | | | |
|---|---|---|---|
| 2003/0150885 | A1 | 8/2003 | Dunne |
| 2003/0192135 | A1 | 10/2003 | Koike et al. |

FOREIGN PATENT DOCUMENTS

| | | | |
|---|---|---|---|
| WO | 2004022143 | A2 | 3/2004 |
| WO | 2011061531 | A1 | 5/2011 |
| WO | 2011128607 | A1 | 10/2011 |

OTHER PUBLICATIONS

International Search Report for Application No. PCT/GB2015/051588 dated Sep. 14, 2015.

Extended European Search Report including Written Opinion for Application No. EP18169107.2 dated Jul. 18, 2018.

VALVE ASSEMBLY

CROSS REFERENCE TO RELATED APPLICATIONS

This application is a national phase entry under 35 U.S.C. § 371 of International Application No. PCT/GB2015/051588, filed Jun. 1, 2015, published in English, which claims the benefit of the filing date of Great Britain Patent Application No. 1409861.0, filed Jun. 3, 2014, the disclosures of which are hereby incorporated herein by reference.

FIELD OF THE INVENTION

The present invention relates to a valve assembly, in particular a valve assembly for use in an aerosol spray device for discharging a liquid product (e.g. a household product such as an air freshener) in the form of a spray. The invention has particular application to aerosol spray devices which utilise a compressed gas propellant rather than a liquefied gas propellant.

BACKGROUND TO INVENTION

Broadly speaking, aerosol spray devices comprise a container holding a liquid to be discharged together and an outlet nozzle associated with a valving arrangement which is selectively operable to allow discharge of the liquid as a spray from the nozzle by means of the propellant provided within the container.

Both "compressed gas propellant aerosols" and "liquefied gas propellant aerosols" are known. The former incorporate a propellant which is a gas at 25° C. and at a pressure of at least 50 bar (e.g. air, nitrogen or carbon dioxide). Such a gas does not liquefy in the aerosol spray device. On opening of the valving arrangement, the compressed gas "pushes" liquid in the spray device through the aforementioned nozzle that provides for atomisation. There are, in fact, two types of "compressed gas propellant aerosols". In one type, only liquid from the container ("pushed-out" by the compressed gas) is supplied to the outlet nozzle. In the other principal type, a portion of the propellant gas from the container is bled into the liquid being supplied to the nozzle which atomises the resulting two-phase, bubble-laden ("bubbly") flow to produce the spray. This latter format can produce finer sprays than the former.

In contrast, "liquefied gas propellant aerosols" use a propellant which is present (in the aerosol spray device) both in the gaseous and liquid phases and is miscible with the latter. The propellant may, for example, be butane, propane or a mixture thereof. On discharge, the gas phase propellant "propels" the liquid in container (including dissolved, liquid phase propellant through the nozzle).

It is well known that "liquefied gas propellant aerosols" are capable of producing finer sprays than "compressed gas propellant aerosols". This is due to the fact that, in the former, a large proportion of the liquefied gas "flash vaporises" during discharge of liquid from the aerosol spray device and this rapid expansion gives rise to a fine spray. Such fine sprays cannot generally be achieved with "compressed gas propellant aerosols", in either of the two principal formats described above.

Attempts have been made to improve the "fineness" of sprays generated by "compressed gas propellant aerosols". Prior art proposals have included the possibility of "bleeding off" some of the compressed gas (e.g. nitrogen) that is present in the container and mixing this with the liquid product to achieve "two fluid atomisation" which is a technique known to provide fine sprays for other areas of spray technology, e.g. liquid fuel combustion. However it has been found extremely difficult to produce fine sprays using two fluid atomisation with aerosol spray devices, and the nearest approach has been to use the equivalent of a vapour phase tap (VPTs are used in "liquefied gas propellant aerosols") to bleed some gas into the valve. However results for improving spray fineness have not been significantly beneficial.

PCT Patent Applications (Publication) Nos. WO 2011/061531 and WO 2011/128607, the contents of which are hereby incorporated by reference, each disclose aerosol spray devices for producing fine sprays in the case of "compressed gas propellant aerosols" (although there is some applicability also to "liquefied gas propellant aerosols"). Devices disclosed in WO 2011/061531 and WO 2011/128607 incorporate a spray discharge assembly incorporating a flow conduit for supplying fluid from a container to a spray outlet region of the device. The flow conduit has at least one first inlet for liquid from the container and at least one second inlet for propellant gas from a head space of the container. The spray discharge assembly further incorporates a valving arrangement such that movement of a valve stem from a first to second limit position opens the first and second inlets to cause a bubble laden flow to be generated in the flow conduit for supply to the spray outlet region. An aerosol device of this general type is illustrated in FIG. 1, which illustrates a known aerosol spray device 1 in the normal "rest" or "closed" position.

The device 1 comprises a pressurised container 2 on the top of which is mounted an spray discharge assembly 3 which, as schematically illustrated in the Figure, is crimped on to the top portion of container 2. Provided within container 2 is a liquid 5 to be dispensed from the device by a pressurised gas such as nitrogen, air or carbon dioxide, which has limited solubility in the liquid 5 and is in a head space 6 of the container 2. The gas in the head space 6 may, for example, be at an initial pressure of 9 to 20 bar depending upon the type of container in use. The initial pressure may, for example, be 9 or 12 bar. There are however higher pressure "standard" cans now available (but as yet little used), for which the initial pressure is for example 18 bar or higher. Such cans can also be used in the present invention. Higher initial can pressure is good because there is more mass of gas available to help atomisation and higher nozzle velocities which also helps atomisation and also the proportionate loss in can pressure as the can empties is less. This helps maintain spray quality and flow rate better during can lifetime.

The valve assembly 3 comprises a generally cylindrical, axially movable valve stem 7 having an axial bore 8 extending from the upper end of valve stem 7 part way towards the lower end thereof. At its lower (proximal) end, valve stem 7 locates within a cylindrical housing 9 positioned internally of the container 2 and at its upper (distal) end is fitted with an actuator in the form of a cap 10 having a spray outlet region 11. Provided at the outlet end of region 11 is a conventional MBU (Mechanical Break-Up Unit) insert 13. The valve assembly 3 is secured to the top of the container 2 by means of a metallic top cap 30 which is crimped at a central portion to the upper end of the valve housing 9 and crimped at an outer periphery to the upper rim 2*a* of the container. An outer gasket (not shown) would typically be secured in place between the upper rim 2*a* and the outer periphery of the top cap 30 to ensure a hermetic seal.

In broad outline, the aerosol spray device 1 is operated by pressing down on the cap 10 to cause downward movement of valve stem 7 to an "open" position with resultant discharge of a spray from spray outlet region 11. As shown in the drawings, valve stem 7 is biased upwardly of the container 2 by means of a coil spring 14. Lower end of coil spring 14 locates around an aperture 16 in lower wall 17 of the housing 9. Depending from wall 17 is a tubular spigot 18 having a lower enlarged end 19 to which is fitted a dip tube 20 which extends to the base of the container 2. It will be appreciated from the drawing that the lower region of container 2 is in communication with the interior of the housing 9 via the dip tube 20, spigot 18 and aperture 16 (which provides a liquid inlet for housing 9).

In certain embodiments disclosed in WO 2011/061531 and WO 2011/128607, such as that illustrated in accompanying FIG. 1, the valve assembly includes a pair of sealing gaskets: a first 23 dedicated to sealing liquid inlets 28 to the stem; and a second 21 dedicated to sealing gas inlets 29 to the stem. The annular gaskets 22 and 23 are formed of rubber or other elastomeric material and are dimensioned to seal against the outer surface of valve stem 7. Formed in the wall of the housing 9 between the two gaskets 22 and 23 are a plurality of ports 24 which provide for communication between the pressurised gas in the head space 6 and an annular clearance 21*a*.

The liquid feed passageways 28 and gas bleed inlet passageways 29 are axially spaced from each other by a distance such that, in the "rest" condition ("closed" position) of the aerosol as shown in FIG. 1, the passageways 29 are sealed by upper gasket 22 and passageways 28 are sealed by lower gasket 23. The cross-sections of the passageways 28 and 29 together with the axial spacing between these passageways and the dimensions of the upper and lower gaskets 22 and 23 are such that on depression of the valve stem 7 to the open position the gas bleed inlet passageways 29 are opened simultaneously with (or more preferably just before) the liquid feed passageways 28, thereby causing the generation of bubble laden flow in the outlet conduit 8 for supply to the spray outlet region 11 for discharge therefrom in the form of a fine aerosol.

In certain other embodiments disclosed in WO 2011/061531 and WO 2011/128607, such as illustrated in accompanying FIG. 2, a single gasket 23 is used to seal both the liquid inlet 72 to the stem and the gas inlet 71 to the stem. On movement of the valve stem 7 from the closed position to the open position, the stem inlets 71, 72 are moved proximally of the gasket 23 and are therefore brought into fluid communication with, respectively, a gas inlet 73 in the housing 9, and a liquid inlet 16 in the housing, thereby causing the generation of bubble laden flow in the outlet conduit 8. Further examples of single gasket embodiments are shown and described by reference to FIGS. 9*a* to 16 of WO 2011/128607, one example of which is shown in the accompanying FIGS. 3*a* to 3*c*, in which the single gasket 23 is in fact formed in two adjacent parts: a thin gasket 112 and an annular seal 111, supported in the housing by a support ring 110.

The thin gasket 112 is shown in greater detail in FIG. 3*c* and comprises a disc having a central aperture 113 that is sized to be a close fit about the valve stem 7. A radial groove 123*a* extends in one side of the disc from the central aperture to an edge of the disc, where the groove connects with an axial notch 123*b* that extends through the edge of the disc. The groove 123*a* and notch 123*b* together comprise a gas inlet port that forms a gas flow path from the headspace 6 to the gas bleed inlet 121 when the valve stem is depressed, as in FIG. 3*b*. A notch 124 extends through the disc 112 at a point at the edge of the aperture 113 diametrically opposite to the groove 123*a*. When the valve stem is depressed, the notch 124 forms a liquid flow path between the annular clearance 21 and the liquid feed inlet 122. The annular clearance 21 is in fluid communication with the liquid inlet 16 in the housing via an axial channel 106 through the lower portion of the valve stem 7 and a transverse opening 108 located at the upper end of the channel 106.

FIG. 3*a* shows the valve stem 7 of this exemplary known single gasket valve assembly in a closed position, in which the valve stem 7 is extended out of the housing 9, under the action of the spring 14, so that the gas bleed inlet(s) 121 and the liquid inlets(s) 122 are each on the opposite (distal) side of the seal 23 to the gasket 112, or are at least blocked by the seal.

An advantage of a single gasket arrangement is that it employs fewer parts and thus reduces material, manufacturing and assembly costs in comparison to double gasket arrangements. Additionally, it may readily be produced in dimensions well suited to manufacture with the same overall dimensions as conventional liquefied gas propellant aerosol valves. However, in such known single gasket arrangements, there is a risk that the gasket may swell from contact with the liquid contents 5 of the spray device, at least for certain liquids. Such swelling would increase the friction between the gasket 23 and the valve stem 7, which could lead to the valve stem becoming stiffer to move or even becoming stuck. Also, in order to ensure that the stem gas and liquid inlets are brought into fluid communication with their associated housing gas and liquid inlets on movement of the stem 7 to the open position, it has been necessary to include features, such as the stem lugs 7*a* and associated housing grooves 9*a* of FIG. 3*b*, to prevent rotation of the valve stem 7 in the housing 9, and to account for proper orientation of the valve stem during assembly.

It is therefore an object of the invention to provide a single gasket valve arrangement in which the liquid contents of the spray device are kept out of contact with the gasket. It is a further object of the invention to provide a single gasket valve arrangement in which the valve stem can be rotated to any position and still function.

SUMMARY OF THE INVENTION

According to a first aspect of the present invention there is provided a valve assembly for an aerosol spray device, the assembly comprising:

- a housing with internal walls defining a valve chamber, the chamber having a liquid inlet for fluid communication with liquid in the aerosol spray device, and a gas inlet for fluid communication with gas in the aerosol spray device; and
- a valve stem having proximal and distal ends, the proximal end received in the valve chamber and the distal end projecting through a sealed opening in the valve chamber, the valve stem including an outlet flow conduit with an outlet aperture at the distal end and, more proximally, at least one first stem inlet for liquid and at least one second stem inlet for gas;
- wherein the housing includes a lip projecting inwardly from the internal walls to form a seal around a perimeter of the valve stem along at least a portion of the valve stem, wherein the valve chamber liquid inlet is proximal of the lip and the valve chamber gas inlet is distal of the lip;

wherein the valve stem is moveable between:

a closed position in which the at least one first stem inlet is distal of the lip and the at least one second stem inlet is distal of the sealed opening in the valve chamber, such that the at least one first stem inlet is not in fluid communication with the valve chamber liquid inlet and such that the at least one second stem inlet is not in fluid communication with the valve chamber gas inlet; and an open position in which the at least one first stem inlet is proximal of the lip so as to be in fluid communication with the valve chamber liquid inlet, and the at least one second stem inlet is proximal of the sealed opening in the valve chamber and at least partially distal of the lip so as to be in fluid communication with the valve chamber gas inlet, whereby a bubble laden flow is created in the flow conduit.

The arrangement means that the liquid flow path is kept separate from the gas flow path (until the valve is in the open position, when the liquid and gas mix in the outlet flow conduit) by virtue of the sealing interface between the lip and the valve stem, rather than by a sealing gasket. The liquid thus never comes into contact with the gasket, and accordingly swelling of the gasket due to such contact is avoided.

Another advantage of the arrangement is that there is no need to align the stem in the housing; the valve will operate with the stem at any rotational orientation within the housing, in contrast to prior art arrangements in which it has been necessary to align the constituent parts of the flow paths in the stem with corresponding constituent parts in the valve housing. This makes manufacture easier, and provides for a more versatile valve.

The number of components is also reduced in comparison to comparable prior art valve assemblies, which thus reduces the complexity and cost of the valve and its manufacture.

The at least one second stem inlet for gas is preferably downstream of said at least one first stem inlet for liquid.

The valve stem is typically biased towards the closed position.

The valve assembly may further comprise a limit stop to prevent movement of the valve stem distally beyond the closed position. The limit stop may comprise a shoulder projecting radially from the valve stem towards the proximal end thereof for abutment against said lip. The shoulder may include a channel which, when the valve stem is in the open position, allows fluid to flow from the valve chamber liquid inlet to the at least one first stem inlet, but which when the valve stem is in the closed position is closed off by the abutment against the lip, preventing the flow of liquid through the channel. The channel may comprise at least one radially extending conduit in fluid communication at one end thereof, in the centre of the valve stem, with a bore from the distal end of the valve stem, and at the other end thereof with a groove in the outer surface of the shoulder running parallel to the bore and to the outlet conduit.

At least the portion of the valve stem about which the lip forms a seal preferably has a constant cross-section. Typically, the valve stem has a circular cross-section.

The housing may comprise a cup portion and a cap portion. The valve chamber liquid inlet may be formed through the cup portion, and the valve chamber gas inlet may be formed through the cap portion.

The valve chamber gas inlet may comprise a plurality of radial grooves defined between corresponding radial ribs on an upper surface of the housing, in conjunction with a conduit through the housing to the outer surface thereof, for communication with the headspace of a container to which the spray device is fitted.

The sealed opening is typically sealed by a gasket, which is preferably a planar, annular gasket. Where the valve chamber gas inlet comprises a plurality of radial grooves defined between corresponding radial ribs on an upper surface of the housing, the gasket preferably also defines an upper bound of the radial grooves in the housing.

In certain prior art arrangements, it has been necessary to provide a separate part to support the gasket within the housing, such as the support ring 110 of FIGS. 3*a* and 3*b*. That is not necessary with the inventive arrangement, in which the upper surface of the housing has a dual purpose of supporting the gasket and defining (part of) the gas flow path.

The aerosol spray device is preferably of the type comprising a pressurised or pressurisable container holding a liquid to be discharged from the device by a propellant that is a gas at a temperature of 25° C. and a pressure of at least 50 bar. This corresponds to "compressed gas propellant aerosols", such as nitrogen or carbon dioxide, which do not have the well-known disadvantages associated with liquefied gas propellant aerosols, such as butane or propane.

According to a second aspect of the invention, there is provided an aerosol spray device comprising a pressurised or pressurisable container holding a liquid to be discharged from the device by a gaseous propellant that is a gas at a temperature of 25° C. and a pressure of at least 50 bar and a spray discharge assembly mounted on the container, said spray discharge assembly incorporating:

the valve assembly according to the first aspect of the invention; and a spray outlet region having an outlet orifice from which fluid from the container is discharged.

The aerosol spray device may further comprise an actuator assembly which is mounted on the valve stem and which incorporates said spray outlet region, said actuator assembly further incorporating a discharge conduit providing a communication between the stem flow conduit and the spray outlet region. The stem outlet flow conduit may be of circular-section as may be the discharge conduit. Preferably the flow and discharge conduits are of identical diameter, ideally in the range 0.5 mm to 1.5 mm. The flow and discharge conduit may each have a length from 3 to 50 times their diameter. The discharge conduit may, throughout its length, be collinear with the flow conduit. Alternatively the discharge conduit may be formed in two sections, namely a first section collinear with the flow conduit and a second section angled (e.g. perpendicular thereto).

The spray outlet region may comprise a nozzle adapted to impart a swirling motion to the bubble laden flow prior to discharge thereof from the device. The nozzle may be a Mechanical Break-Up Unit.

According to some embodiments, the aerosol spray device contains a material selected from the group consisting of pharmaceutical, agrochemical, fragrance, air freshener, odour neutraliser, sanitizing agent, polish, insecticide, depilatory chemical (such as calcium thioglycolate), epilatory chemical, cosmetic agent, deodorant, anti-perspirant, anti-bacterial agents, anti-allergenic compounds, and mixtures of two or more thereof.

The present invention has been found particularly applicable in the case where the spray outlet region comprises a nozzle adapted to impart a swirling motion to the bubble laden flow prior to discharge thereof from the device. The nozzle may be a Mechanical Break-Up Unit, for which further detailed examples are given below. With such units, it has been found that good atomisation of the liquid being discharged is obtained, resulting in a fine spray. Aerosol spray devices in accordance with the invention are eminently suitable for use in conjunction with a variety of consumer products, e.g. air-fresheners, polishes, insecticides, deodorants and hairspray.

The invention is particularly effective for spray devices where the spray outlet region comprises a nozzle adapted to impart a swirling motion to the bubble laden flow prior to discharge thereof from the device. The nozzle may be a conventional Mechanical Break-Up unit. Thus, the nozzle, may comprise a discharge orifice, a swirl chamber provided around the discharge orifice and one or more channels ("swirl channels" or "swirl arms") extending outwardly from the swirl chamber. In such an arrangement, the flow conduit is in communication (e.g. via a discharge conduit in an actuator assembly) with the outer end(s) of the channel(s) so that the bubble laden flow is supplied to the swirl chamber for discharge through the orifice.

The discharge orifice of the nozzle may, for example, have a diameter of 0.15-0.8 mm. There may be from 1 to 8 swirl channels each having a width of 0.1 mm-0.5 mm and a depth of 0.1 mm-0.5 mm. The swirl chamber may be circular with a diameter of 0.3 mm to 2 mm.

The nozzle may comprise an insert having a face locating against a face of a boss in the spray outlet region of the device, wherein said discharge orifice is provided in the insert and wherein said faces of the boss and the insert are configured to define the swirl chamber and the channels.

Such a valving arrangement of the first aspect of the invention is not limited in application to aerosol spray devices of the type defined in the second aspect of the invention, although they do have particular application thereto. Rather, the valving arrangements of the first aspect of the invention may be applied to any suitable aerosol spray device.

As with one embodiment of the first aspect of the invention, a lower region of the valve stem may locate within the housing and the single seal may be mounted on the housing for relative sliding engagement with the valve stem.

BRIEF DESCRIPTION OF THE DRAWINGS

The invention will be further described by way of example only with reference to the accompanying drawings, in which.

DETAILED DESCRIPTION

Figure 1:
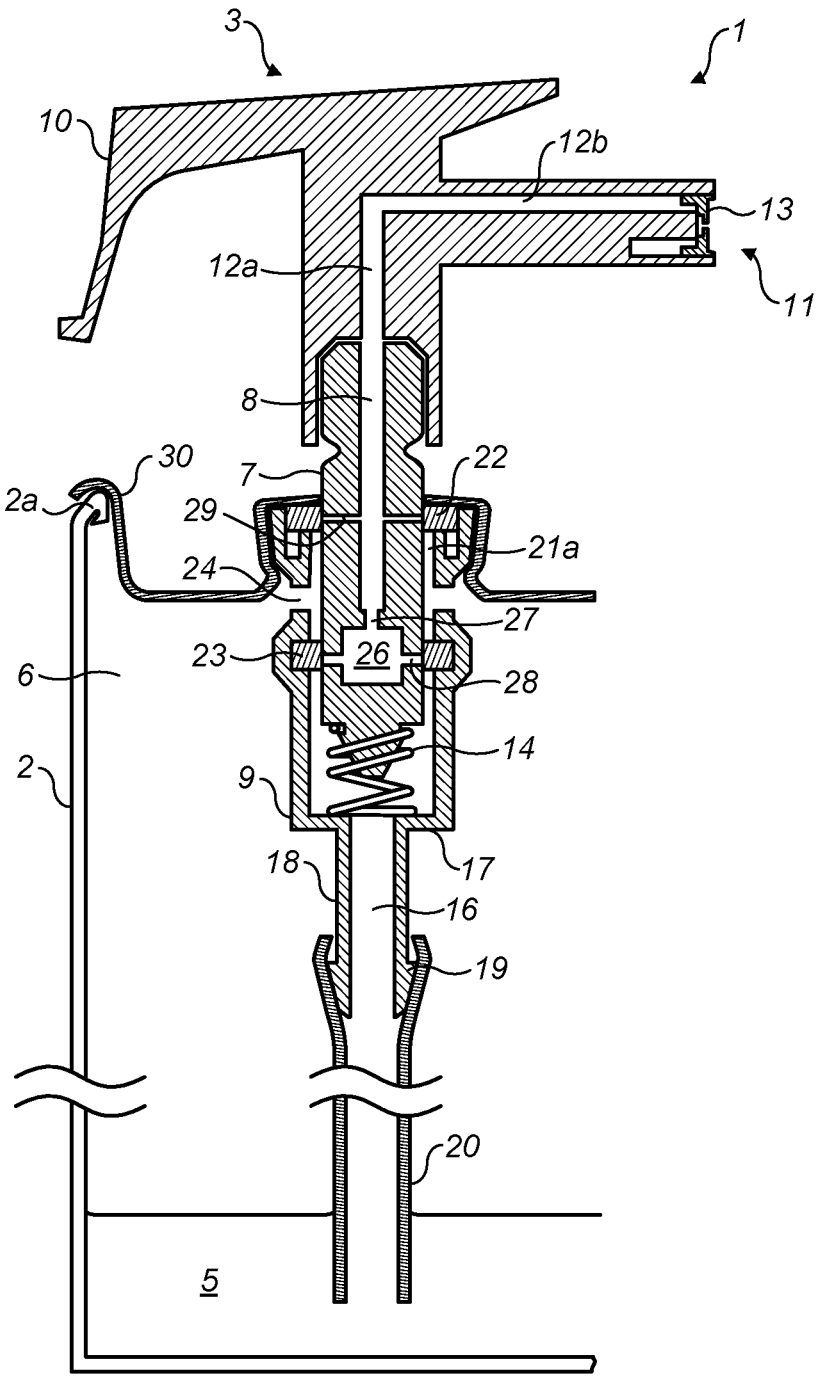
FIG. 1 Prior Art
FIG. 1 schematically illustrates a first known aerosol spray device, with a valve assembly having a pair of sealing gaskets.

A valve assembly 200 according to the invention is illustrated in the accompanying FIGS. 4*a* to 7. Such a valve assembly is for incorporation into an aerosol spray device 1 of the type generally described in the introductory portion and comprising a container 2, within which is a liquid 5 to be dispensed from the device by a pressurised gas such as nitrogen, air or carbon dioxide, which has limited solubility in the liquid 5 and is in a head space 6 of the container 2.

The valve assembly 200 of the invention would replace the valve stem 7 and housing 9 combination of the prior art, located between the dip tube 20 and the actuator 10.

The valve assembly 200 comprises a housing 202 with internal walls defining a valve chamber 204, and a valve stem 220. The housing 202 is formed of two portions: a lower, cup portion 206; and an upper, cap portion 208. As described above by reference to the prior art, the valve assembly 200 would be crimped in place at the top of a container, with a distal portion of the valve stem 220 projecting from the top of the container for connection to an actuator.

The cup portion 206 has a lower wall 210 with an aperture 212 therethrough. A tubular spigot 214 depends from the lower wall 210. A dip tube (not shown) would be connected to the tubular spigot 214, typically by means of an enlarged lower end as described by reference to the prior art of FIG. 1, the dip tube extending to the base of the container to which the valve assembly 200 is fitted. It will be appreciated that the lower region of a container to which the valve assembly 200 is fitted is in communication with the valve chamber 204 via the dip tube, spigot 214 and aperture 212 (which provides a liquid inlet for the valve chamber).

The cap portion 208 comprises a generally cylindrical inner wall 224 from which a lip 226 projects inwardly at the upper end thereof. The lower end 228 of the cap portion has a narrower outer diameter so as to fit with an interference fit inside the cup portion 206. At the upper end of the cap portion 208, an annular rim 230, together with an upper surface 232, defines a shelf within which an annular sealing gasket 260 sits.

A plurality of radial grooves 234 are defined between corresponding radial ribs 236 on the upper surface 232. Inner ends 234*a* of the grooves 234 open into the upper end of the valve chamber, above the lip 226. Outer ends 234*b* of the grooves 234 open into a circumferential groove 238, which circumscribes the upper surface 232 just inside the rim 230. The lower and side surfaces of the respective grooves 234, 238 are formed by the cup portion itself, whereas the upper surfaces thereof are formed by the lower surface 262 of the gasket 260.

A conduit 240 is formed through the cap portion 208, with an upper end opening into the circumferential groove 238 via a hole 242, and with a lower end exiting the side of the cup portion via a hole 244 in the outer surface thereof. It will be appreciated that the head space of a container to which the valve assembly 200 is fitted is in communication with the valve chamber 204 via the conduit 240, circumferential groove 238 and radial grooves 234 (which together provide a gas inlet for the valve chamber).

The valve stem 220 is generally cylindrical, having an outer surface 272 with a diameter equal to the inner diameter of the lip 226 such that the lip 226 forms a seal around the perimeter of the valve stem. A proximal end 274 of the valve stem is received in the valve chamber 204 and a distal end 276 projects through the centre 264 of the annular sealing gasket 260, which is dimensioned to seal against the outer surface 272 of the valve stem 220. The lower surface 262 of the gasket 260 defines the top of the valve chamber 204.

The valve stem 220 includes an outlet flow conduit 280 with an outlet aperture 282 at the distal end 276 and, more proximally, at least one first stem inlet 284 for liquid and at least one second stem inlet 286 for gas. As illustrated, there is a single stem inlet 284 for liquid and a single stem inlet 286 for gas, and they are positioned roughly in the middle of the valve stem, with the gas inlet 286 being slightly distal of the liquid inlet 284. It will be understood that alternative arrangements are envisaged. For example, there could be multiple liquid inlets 284 and/or multiple gas inlets 286; the inlets 284, 286 could be located more proximally or more distally than shown; and the axial separation between the respective liquid and gas inlets could be greater than shown.

Towards the proximal end 274 of the valve stem 220, an enlarged shoulder portion 290 projects radially from the cylindrical valve stem 220. The diameter of the shoulder 290 is substantially equal to that of the valve chamber 204. A bore 292 runs centrally from the proximal end face 275 valve stem 220 to the shoulder portion 290. Four conduits 294 extend radially within the shoulder portion 290 from the centre, where they open into the bore 292, to the outside. At the outer ends, the radial conduits 294 open into respective axial grooves 296 in the outer surface of the shoulder 290 that run parallel to the bore 292 and to the outlet conduit 280.

Figure 4A:
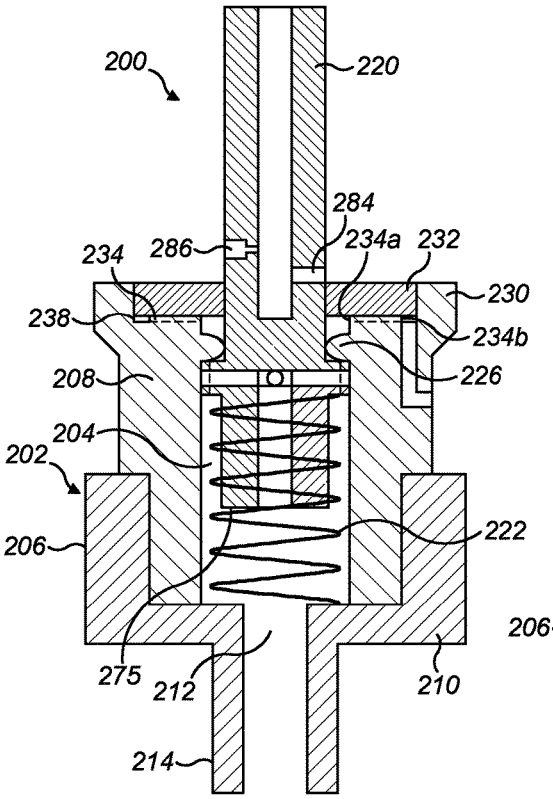
FIGS. 4*a* and 4*b* schematically illustrate a valve assembly in accordance with the invention in respective closed and open positions.

As shown in the drawings, the valve stem 220 is biased upwardly of the valve assembly (and thus of the aerosol device) by means of a coil spring 222. Lower end of coil spring 222 locates around the aperture 212 of the cup portion 206 of the housing 202. In the closed valve position, as shown in FIG. 4*a*, the shoulder 290 abuts against the lip 226 under the force of the spring 222, and the flow channel defined by the bore 292, radial conduits 294 and axial grooves 296 is blocked by virtue of the tops of the axial grooves 296 abutting against the underside of the lip 226. Furthermore, the liquid inlet 284 is more distal than the sealing gasket 260. Accordingly, there is no fluid communication between the valve chamber liquid inlet 212 and the outlet conduit 280. There is also no fluid communication between the valve chamber gas inlet 234*a* and the outlet conduit 280, because the gas inlet 286 is also more distal than the sealing gasket 260, which hermetically seals against the outer surface 272 of the valve stem.

The abutment of the shoulder 290 against the lip 226 acts as an upper limit stop, preventing the valve stem 220 from being urged further out of the valve housing 202.

Figure 4B:
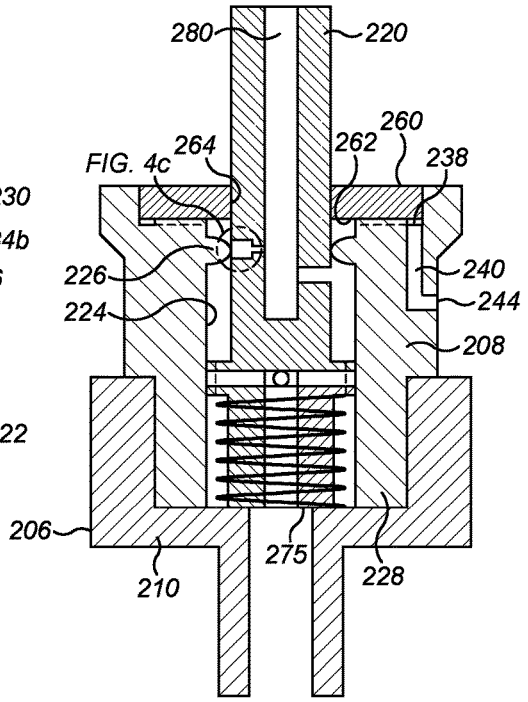

When the valve stem is moved to the open position, as shown in FIG. 4*b*, the stem liquid inlet 284 is moved below (i.e. proximal of) the lip 226 so as to be in fluid communication with the valve chamber liquid inlet 212 via the flow channel defined by the bore 292, radial conduits 294 and axial grooves 296 through the stem shoulder portion 290. Also, the stem gas inlet 286 is moved below (i.e. proximal of) the sealing gasket 260 to a position at the upper end of the valve chamber 204 in fluid communication with the valve chamber gas inlet 234*a*. At least a part of the stem gas inlet 286 must be open to the upper portion of the valve chamber 204 (i.e. the portion above the lip 226). Abutment of the bottom face 275 of the valve stem 220 against the lower wall 210 of the cup portion 206 defines a lower limit stop.

Thus, to operate the device, an actuator cap 10 is depressed so that the valve stem 220 moves downwardly against the bias of spring 222 from the closed position to the open position. As a result, the liquid and gas stem inlets 284, 286 are displaced past the gasket 260 and brought into respective fluid communication with liquid (or powder) 5 from the container 2 and compressed gas from the head space 6.

Compressed gas can now flow into the outlet conduit 280 by passage through the hole 244 in the outer surface of the cap portion 208, the conduit 240, the hole 242, the circumferential groove 238 and radial grooves 234, and through the stem gas inlet 286.

Liquid 5 can now flow into the upper portion of the valve chamber 204 by passage upwardly along the dip tube 20, through the inlet 212, the bore 292, the radial conduits 294 and the axial grooves 296. Liquid 5 introduced into the upper portion of the valve chamber 204 passes via stem liquid inlet 284 into flow conduit 280 where it is mixed with the compressed gas bled through the stem gas inlet 286. A bubble laden flow of homogeneous bubbles with similar diameters and without significant coalescence or stratification is formed in the outlet flow conduit 280.

That bubbly flow can then flow, preferably undisturbed, through the actuator 10, such as one of the type disclosed in FIG. 1, to a spray outlet region 11. This actuator cap 10 (which may be of the type available under the name "Kosmos" from Precision Valve (UK) Ltd) is moulded so as to locate on the top of valve stem 7, 220 and has an internal L-shaped conduit formed as a first section 12*a* collinear with the outlet bore 8, 280 of valve stem 7, 220 and a second section 12*b* that extends at right angles to section 12*a* and leads to spray outlet region 11. Other different actuators could be used instead; a number of different exemplary styles are disclosed in WO 2011/061531 and WO 2011/128607. The substantially disturbance-free flow of the bubble laden flow can be achieved by configuring the outlet flow conduit 280 and the flow conduit through the actuator such that there is an absence of any flow disturbances, whereby the bubble laden flow is delivered to the spray outlet region in substantially the form in which it was created.

The bubble laden flow should be at a velocity that gives a sufficiently short residence time of the flow in the outlet flow conduit 280 and the flow conduit through the actuator such that bubble coalescence or stratification does not occur. Typically the flow rate should be in the range 0.5 to 5 m/s.

The bubble laden flow should be at between 1 bar and 20 bar pressure, and in a preferred embodiment for a consumer aerosol can, between 4 bar and 12 bar (said pressure reducing during evacuation of the can).

The ratio of volume of gas/volume of liquid contained in the bubble laden flow in the outlet flow conduit 280 should be between 0.2 and 3.0 at the pressure prevailing in this conduit and more preferably between 0.3 and 1.3.

Preferably, the conduits and outlet region (including any MBUs 13 that might be required) of the actuator 10 can be selected so as to be ideally suited to the flow and aerosolisation of whichever liquid (or powder) product is to be dispensed therefrom.

Figure 4C:
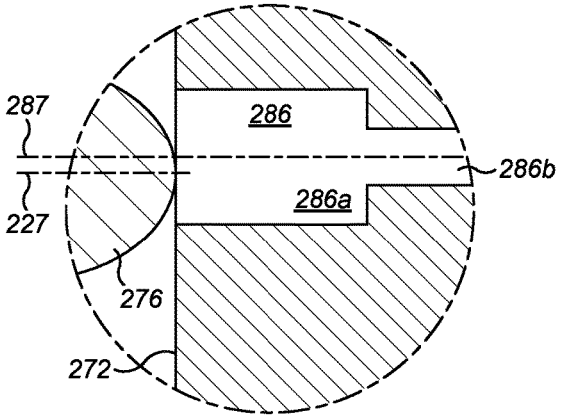
FIG. 4*c* is a detail view of part of FIG. 4*b*, showing the relative positions of an annular lip and a stem gas inlet.
Figure 5A:
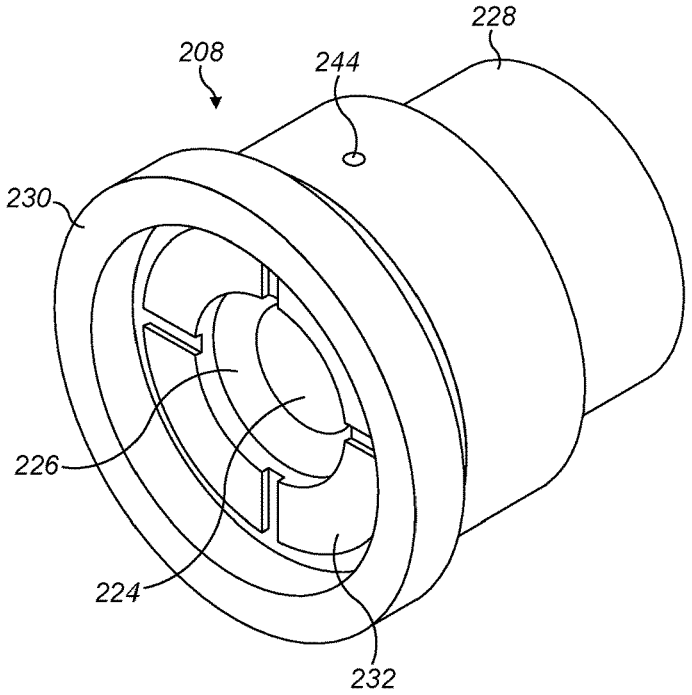
FIGS. 5*a* and 5*b* are perspective views of a cap part of the valve housing, showing gas flow conduits.
Figure 5B:
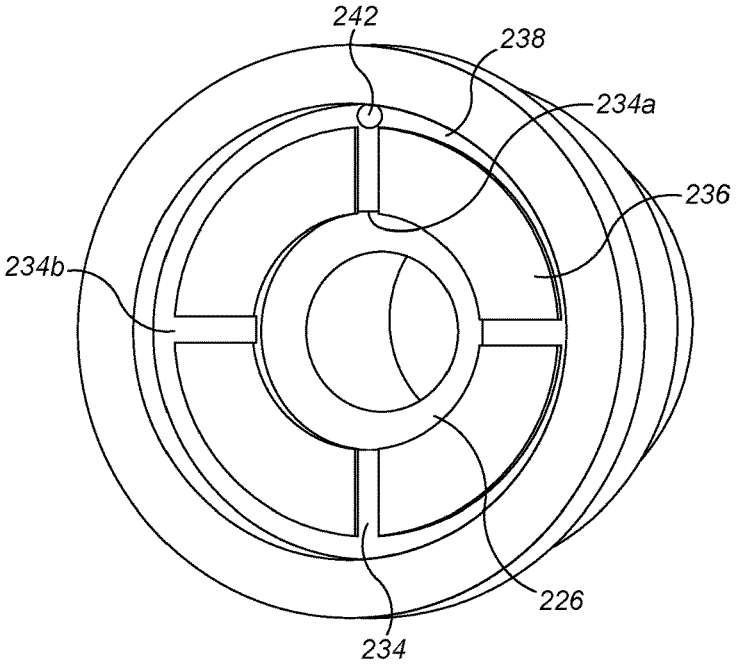
Figure 6:
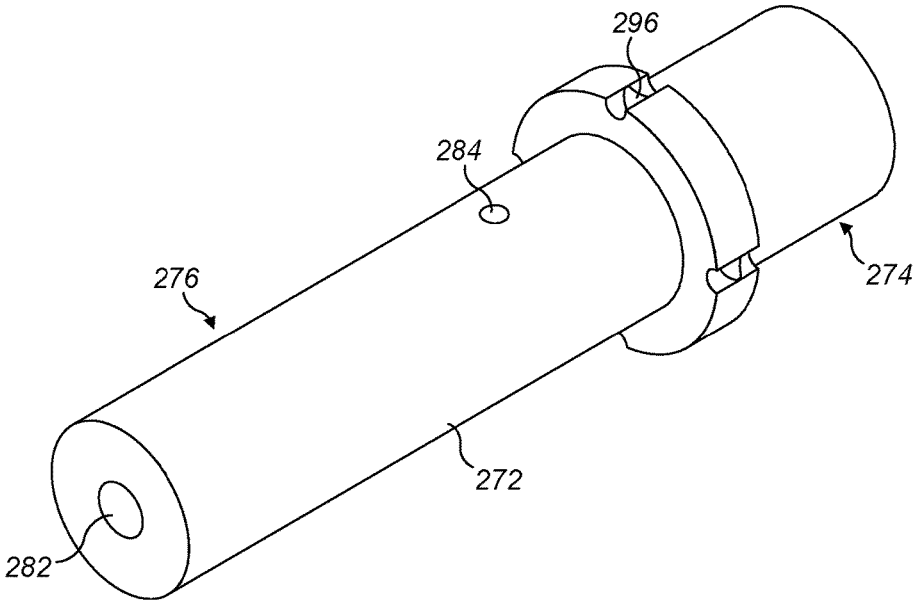
FIG. 6 is a perspective view of a stem forming part of the valve assembly in accordance with the invention.
Figure 7:
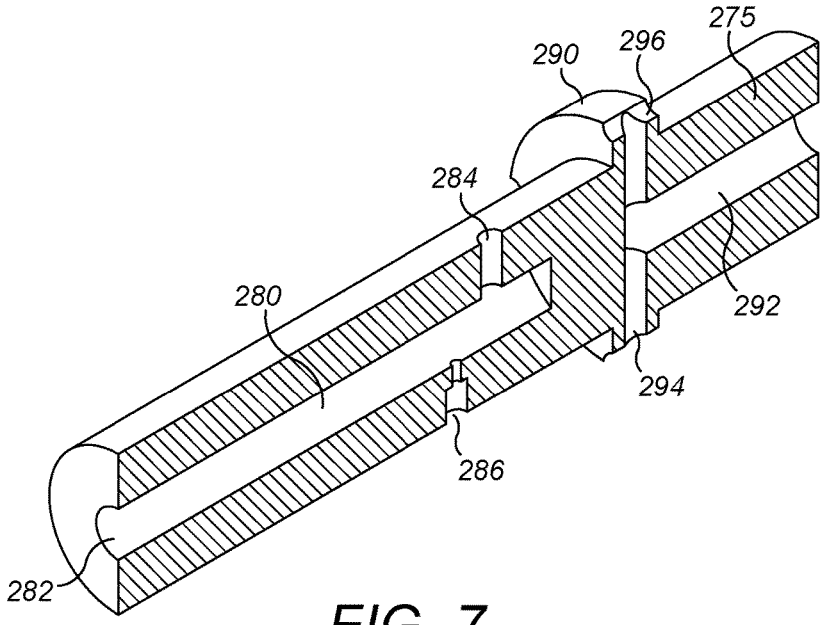
FIG. 7 is a cross section through the stem of FIG. 6.

Preferably, as shown in FIG. 4*c*, the stem gas inlet 286 is moved to a position in which it is marginally offset distally from the lip 226—i.e. a central axis 287 of the stem gas inlet 286 is just above the centreline 227 of the lip 226. This allows not only gas from the valve chamber gas inlet 234*a* to enter the stem gas inlet 286, but also a small amount of liquid from the valve chamber liquid inlet 212 too.

Preferably, the stem gas inlet 286 is stepped, having an outer portion 286*a* (opening to the stem surface 272) with a larger diameter than an inner portion 286*b* (opening to the outlet conduit 280). Alternatively, the stem gas inlet 286 may have a conical cross-section, tapering from a larger outer portion to a smaller inner portion. The advantage of such gas inlet profiles is to assist in manufacture: when moulding the valve stem, pins are typically inserted into the mould to provide for the respective gas and liquid inlets. By having a tapered or stepped profile to the gas inlet, the corresponding pin can have a matching profile, thereby being thicker and stronger at its root than would be the case with a constant diameter pin (matching the narrowest diameter required for the gas inlet). However, a constant diameter gas inlet 286 could be used instead.

In the construction of the valve assembly 200, it should be ensured that the total cross-sectional area of the gas bleed passageways 240, 238, 234, 286 should not be so large that excessive gas is bled into the outlet conduit 280 such that the container 2 is depleted of pressurised gaseous propellant before all of the liquid 5 in the container has been discharged. Typically, the total cross-sectional area of the gas bleed inlet passageways should be equivalent to that of a singular, circular section inlet with a diameter of 0.15-0.8 mm.

Preferred dimensions for the construction of the valve assembly 200 to ensure production of a bubble laden flow of homogeneous bubbles with similar diameters and without coalescence or stratification are shown in the following table:

| Item | Reference Numeral | Diameter (mm) | Length (mm) |
|---|---|---|---|
| Stem | | | |
| Portion of valve stem above shoulder | 272 | 3.2 | 11.4 |
| Portion of valve stem below shoulder | 274 | 3.5 | 3.65 |
| Stem shoulder portion | 290 | 4.7 | 1.0 |
| Outlet conduit in valve stem | 280 | 1.0 | 10 |
| Stem liquid inlet | 284 | 0.5 | 1.1 |
| Stem gas inlet | 286 | 0.2 | 1.1 |
| Outer portion of stem gas inlet | 286a | 0.5 | 0.7 |
| Inner portion of stem gas inlet | 286b | 0.2 | 0.4 |
| Distance of stem gas inlet from distal end of stem | | | 7.8 |
| Distance of stem liquid inlet from distal end of stem | | | 8.6 |
| Stem bore | 292 | 1.0 | 4.4 |
| Radial conduit | 294 | 0.5 | 1.6 |
| Axial groove | 296 | 0.5 (0.25 radius) | 1.0 |
| Housing | | | |
| Cup portion outer diameter | 206 | 12 | 5.4 |
| Cup portion inner diameter | | 8.0 | 4.2 |
| Spigot | 214 | 4.0 | 4.8 |
| Aperture | 212 | 2.0 | 6.0 |
| Cap portion lower end | 228 | 8.0 | 4.2 |
| Inner wall | 224 | 4.8 | |
| Lip | 226 | 3.2 | 0.91 |
| Rim | 230 | 11.5 | 1.1 |
| Circumferential groove | 238 | 9.1 | 0.5 (width); 0.2 (height) |
| Gas hole | 242 | 0.5 | |

-continued

| Item | Reference Numeral | Diameter (mm) | Length (mm) |
|---|---|---|---|
| Gas hole | 244 | 0.5 | |
| Conduit | 240 | 0.5 | |
| Radial groove | 234 | 0.5 | |
| Offset: stem gas inlet to lip (in open position) | 227/287 | | 0.06 |

With the dimensions as indicated above, the valve assembly 200 is particularly suitable for consumer aerosol products such as polishes, insecticides, deodorants, hairspray and air fresheners.

It will be appreciated that the specific dimensions and arrangement of the various constituent parts of the respective gas and liquid flow paths are by way of example only and that alternative arrangements are envisaged. What is key is for the valve chamber gas inlet 234*a* to be distal of the lip 226 and for the valve chamber liquid inlet 212 to be proximal of the lip 226, whilst the stem gas and liquid inlets are positioned such that the stem liquid inlet is brought into fluid communication with the valve chamber liquid inlet and the stem gas inlet is brought into fluid communication with the valve chamber gas inlet on actuating the valve to the open position.

In particular, the arrangement of the flow passage 292, 294, 296 through and past the stem shoulder portion 290 could be omitted, so long as the stem liquid inlet is only brought into fluid communication with the valve chamber liquid inlet in the open position; the flow path being blocked by virtue of the lip 226 when in the closed position.

Also, whereas the valve assembly is described as having four radial conduits 294 and associated axial grooves 296, there may be fewer or more. Likewise, four radial grooves 234 are illustrated, but there may more or fewer.

Furthermore, although described as generally cylindrical, the stem 220 may take other generally prismatic profiles (such as square), with appropriate adaptation of mating parts such as the gasket 260 and the lip 226 and the inner walls 224 of the cap portion 208. Similarly, the shape of the outer surface of the housing 202 does not have to be generally round in cross-section.

For a given exit orifice size the dependency of gas and liquid flow rates on gas and liquid inlet diameters is complex; for example it is proposed that reducing the liquid inlet diameter produces a lowering of pressure inside the conduit which increases the inflow of gas into the conduit. However this increased gas inflow can increase the blockage of the bubbly flow at the swirl inlets and exit orifice of an MBU, which produces a lowering of the liquid inflow rate from the value expected.

To minimise the droplet sizes it is necessary to maximise the gas/liquid volume ratio however smaller exit orifices and higher canister pressures also reduce drop size. The ratio of volume of gas/volume of liquid contained in the bubble laden flow in the flow conduit should typically be between 0.2 and 3.0 at the pressure prevailing in this conduit and more preferably between 0.3 and 1.3, although ratios as high as 9.0 can still produce satisfactory results.

Method of Assembly

Figure 2:
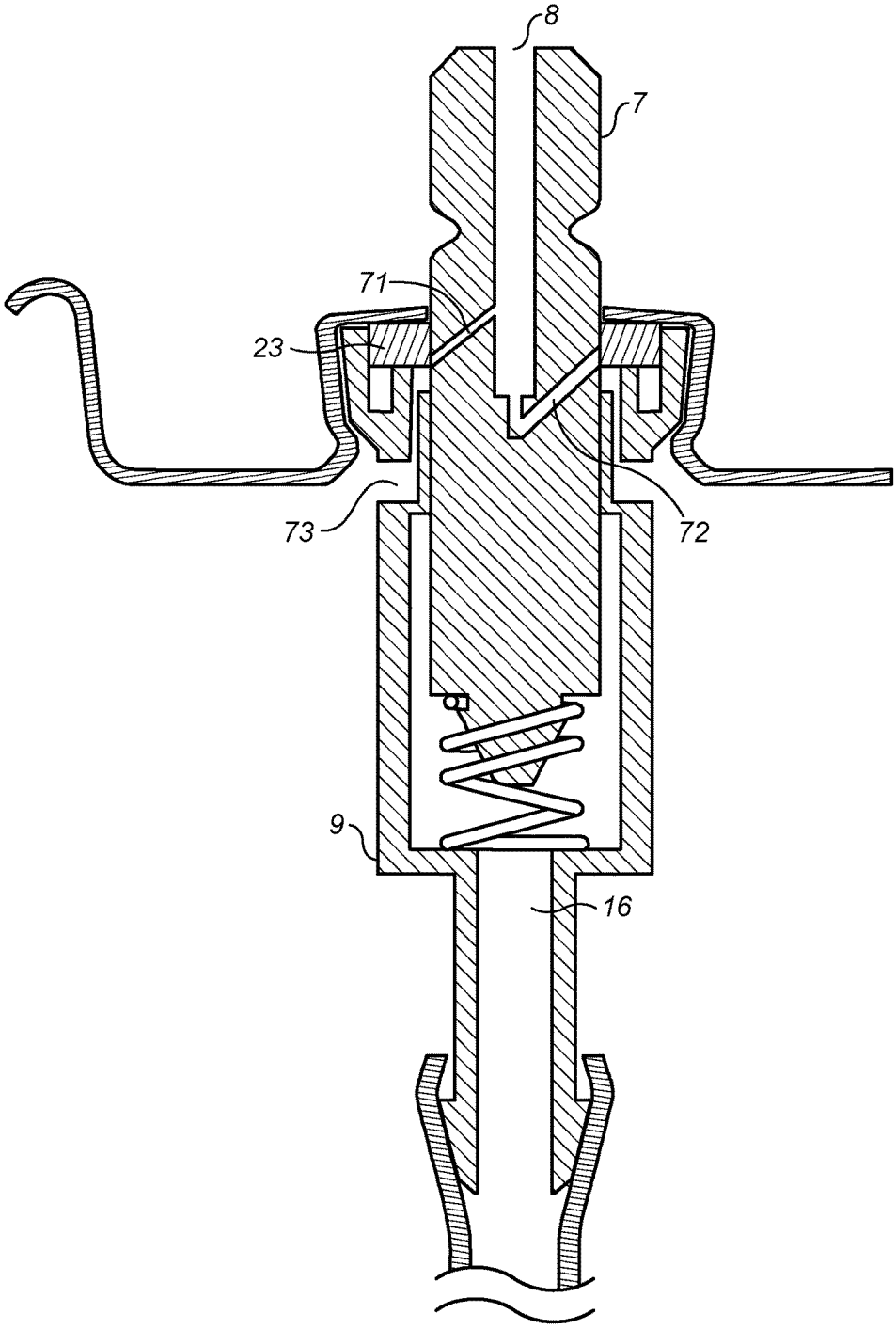
FIG. 2 Prior Art
FIG. 2 schematically illustrates a second known aerosol spray device with a valve assembly having a single sealing gasket n.
Figure 3A:
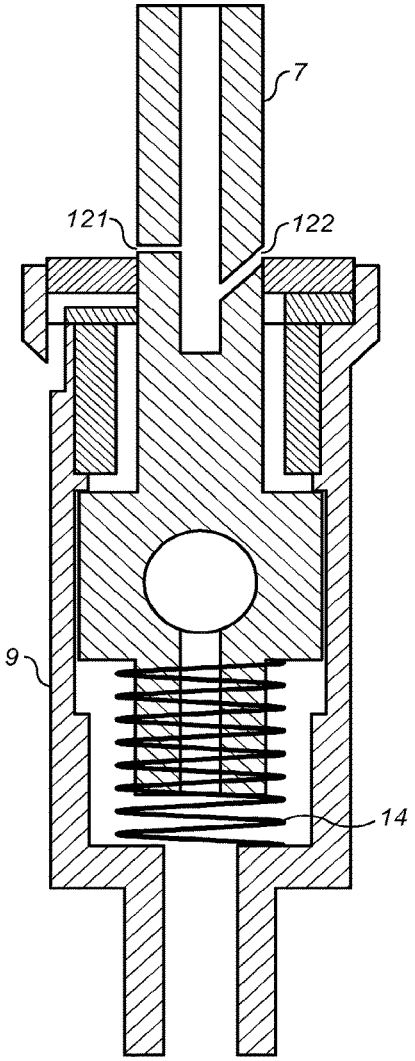
FIG. 3a PRIOR ART
FIGS. 3*a* to 3*c* schematically illustrate a third known aerosol spray device, with an alternative valve assembly having a single sealing gasket formed from two adjacent parts.
Figure 3B:
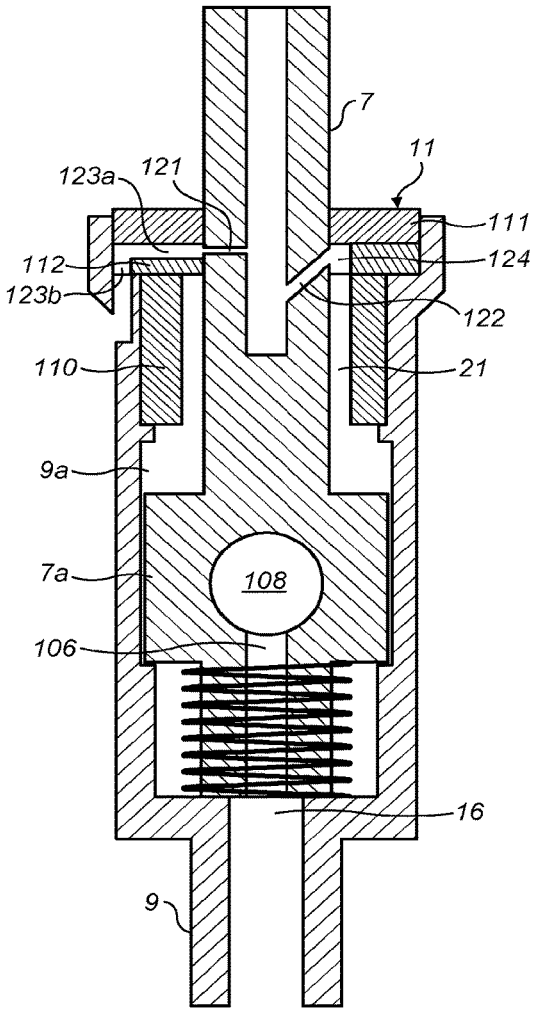
FIG. 3b PRIOR ART
Figure 3C:
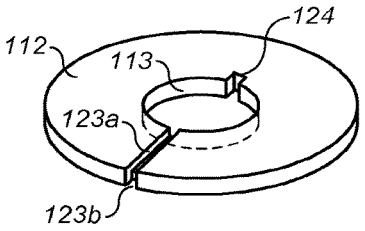
FIG. 3c PRIOR ART

In known valve assemblies, such as those described by reference to the accompanying FIGS. 1 and 2, the stem 7 is typically inserted into the housing 9 from above (after dropping in the spring 14, or having already attached the spring to the bottom of the valve stem), and the assembly 3 can then be crimped together with the top cap 30, securing the sealing gasket(s) in place and securing the assembly to a container 2. By virtue of the lip 226, and the shoulder 290 of the present invention, it would not be possible to insert the valve stem 220 into the housing 202 from above. Accordingly, a modified assembly process is carried out.

In essence, assembly is initially carried out upside-down. Reference to upper and lower portions, etc., should be taken as references to those portions in their usual orientation in use (i.e. an upper portion is closer to the top of a valve assembly and to the outlet spray region of a container to which it is attached than a lower portion).

Thus, to assemble a valve assembly 200 according to the invention, a gasket 260 is placed into the central portion of an inverted top cap 30, and an inverted valve cap portion 208 is placed on top, so that the gasket 260 is held in place between the top cap 30 and the shelf on the 'upper' surface 232. A valve stem 220 is inserted, distal end 276 first, through the cap portion 208 in the direction from the narrower 'lower' end 228 towards the upper surface 232. The distal end 276 passes through lip 226 with an interference fit until the shoulder 290 abuts against the lip 226. The spring 222 can then be slid over the 'lower' proximal end 274 of the valve stem. Alternatively, the spring 222 could be inserted together with the stem 220. The cup portion 206 can then be snap-fitted onto the cap portion 208.

The assembled top cap 30, housing 202 and stem 220 can then be inverted (to the upright orientation) for crimping of the central portion of the top cap 30, to secure the cap portion 208 thereto, ensuring that the hole 244 is not obstructed by the crimped top cap 30 to ensure that the gas flow passageway is viable. A dip tube 20 can then be secured to the spigot 214 at the bottom of the cup portion 206.

Alternative orders of the assembly steps can readily be envisaged, such as assembling the cup and cap portions 206, 208 of the valve housing together (after the insertion of the stem 207 and spring 222 into the cap portion 208) prior to placement onto the top cap 30 with gasket 260, or placing the gasket 260 on to the top of the assembled cup and cap portions after having been inverted to the upright orientation, then placing the top cap 30 over the gasket and valve housing combination prior to crimping. Moreover, the crimping step and the fitting of the dip tube could instead take place with the assembly in an inverted orientation.

The invention claimed is:

1. A valve assembly for an aerosol spray device, the assembly comprising:

a housing with internal walls defining a valve chamber, the valve chamber having a liquid inlet for fluid communication with liquid in the aerosol spray device, and a gas inlet for fluid communication with gas in the aerosol spray device; and a valve stem having a proximal end and a distal end, the proximal end received in the valve chamber and the distal end projecting through a sealed opening in the valve chamber, the valve stem including an outlet flow conduit with an outlet aperture at the distal end and, more proximally, at least one first stem inlet for liquid and at least one second stem inlet for gas;

wherein the housing includes a lip projecting inwardly from the internal walls around at least a perimeter of the valve stem to form a seal around the entire perimeter of the valve stem, wherein the valve chamber liquid inlet is proximal of the lip and the valve chamber gas inlet is distal of the lip;

wherein the valve stem is moveable between:

a closed position in which the at least one first stem inlet is distal of the lip and the at least one second stem inlet is distal of the sealed opening in the valve chamber, such that the at least one first stem inlet is not in fluid communication with the valve chamber liquid inlet and such that the at least one second stem inlet is not in fluid communication with the valve chamber gas inlet; and an open position in which the at least one first stem inlet is proximal of the lip so as to be in fluid communication with the valve chamber liquid inlet, and the at least one second stem inlet is proximal of the sealed opening in the valve chamber and at least partially distal of the lip so as to be in fluid communication with the valve chamber gas inlet, whereby a bubble laden flow is created in the outlet flow conduit.

2. The valve assembly of claim 1, wherein the at least one second stem inlet for gas is downstream of the at least one first stem inlet.

3. A valve assembly of claim 1, wherein the valve stem is biased towards the closed position.

4. A valve assembly of claim 1, further comprising a limit stop to prevent movement of the valve stem distally beyond the closed position.

5. The valve assembly of claim 4, wherein the limit stop comprises a shoulder projecting radially from the valve stem towards the proximal end thereof for abutment against the lip.

6. The valve assembly of claim 5, wherein the shoulder includes a channel which, when the valve stem is in the open position, allows fluid to flow from the valve chamber liquid inlet to the at least one first stem inlet, but which when the valve stem is in the closed position is closed off by the abutment against the lip, preventing flow of liquid through the channel.

7. The valve assembly of claim 6, wherein the channel comprises at least one radially extending conduit in fluid communication at one end thereof, in the centre of the valve stem, with a bore from the distal end of the valve stem, and at the other end thereof with a groove in an outer surface of the shoulder running parallel to the bore and to the outlet flow conduit.

8. The valve assembly of claim 1, wherein at least the portion of the valve stem about which the lip forms a seal has a constant cross-section and wherein the valve stem has a circular cross-section.

9. The valve assembly of claim 1, wherein the housing comprises a cup portion and a cap portion.

10. The valve assembly of claim 9, wherein the valve chamber liquid inlet is formed through the cup portion, and the valve chamber gas inlet is formed through the cap portion.

11. The valve assembly of claim 1, wherein the valve chamber gas inlet comprises a plurality of radial grooves defined between corresponding radial ribs on an upper surface of the housing, in conjunction with a conduit through the housing to the outer surface thereof, for communication with a headspace of a container to which the aerosol spray device is fitted.

12. The valve assembly of claim 11, wherein the sealed opening is sealed by a gasket, the gasket defining an upper bound of the radial grooves in the housing.

13. The valve assembly of claim 1, wherein the sealed opening is sealed by a gasket.

14. The valve assembly of claim 1, wherein the aerosol spray device comprises a pressurised or pressurisable container holding a liquid to be discharged from the device by a propellant that is a gas at a temperature of 25° C. and a pressure of at least 50 bar.

15. An aerosol spray device comprising a pressurised or pressurisable container holding a liquid to be discharged from the device by a gaseous propellant that is a gas at a temperature of 25° C. and a pressure of at least 50 bar and a spray discharge assembly mounted on the container, the spray discharge assembly incorporating:

the valve assembly according to claim 1; and a spray outlet region having an outlet orifice from which fluid from the container is discharged.

16. The aerosol spray device of claim 15, further comprising an actuator assembly which is mounted on the valve stem and which incorporates the spray outlet region, the actuator assembly further incorporating a discharge conduit providing a communication between the stem flow conduit and the spray outlet region.

17. The aerosol spray device of claim 15, wherein the spray outlet region comprises a nozzle adapted to impart a swirling motion to the bubble laden flow prior to discharge thereof from the device.

18. The aerosol spray device of claim 17, wherein the nozzle is a Mechanical Break-Up Unit.

19. The aerosol spray device of claim 15, which contains a material selected from the group consisting of pharmaceutical, agrochemical, fragrance, air freshener, odour neutraliser, sanitizing agent, polish, insecticide, depilatory chemical, epilatory chemical, cosmetic agent, deodorant, anti-perspirant, anti-bacterial agents, anti-allergenic compounds, and mixtures of two or more thereof.

20. A valve assembly for an aerosol spray device, the assembly comprising:

a housing with internal walls defining a valve chamber, the valve chamber having a liquid inlet for fluid communication with liquid in the aerosol spray device, and a gas inlet for fluid communication with gas in the aerosol spray device; and a valve stem having a proximal end and a distal end, the proximal end received in the valve chamber and the distal end projecting through a sealed opening in the valve chamber, the valve stem including an outlet flow conduit with an outlet aperture at the distal end and, more proximally, at least one first stem inlet for liquid and at least one second stem inlet for gas;

wherein the housing includes a lip projecting inwardly from the internal walls around at least a perimeter of the valve stem to form a seal around the entire perimeter of the valve stem, wherein the valve chamber liquid inlet is proximal of the lip and the valve chamber gas inlet is distal of the lip;

wherein the valve stem is moveable between:

a closed position in which there is no fluid communication between the valve chamber liquid inlet and the outlet conduit and there is no fluid communication between the valve chamber gas inlet and the outlet conduit; and an open position in which the at least one first stem inlet is proximal of the lip so as to be in fluid communication with the valve chamber liquid inlet, and the at least one second stem inlet is proximal of the sealed opening in the valve chamber and at least partially distal of the lip so as to be in fluid communication with the valve chamber gas inlet, whereby a bubble laden flow is created in the outlet flow conduit.

* * * * *